US005773745A

United States Patent [19]

Widmer

[11] Patent Number: 5,773,745

[45] **Date of Patent: *Jun. 30, 1998**

[54] METHOD AND DEVICE FOR CUTTING AND DISPENSING OF ADVERSARIAL INTERACTION COUNTERMEASURES

[75] Inventor: Marcel Widmer, Coral Springs, Fla.

[73] Assignee: Alliant Defense Electronic Systems, Inc., Hopkins, Minn.

[ * ] Notice: The term of this patent shall not extend beyond the expiration date of Pat. No. 5,663,518.

[21] Appl. No.: 744,412

[22] Filed: Nov. 7, 1996

Related U.S. Application Data

[63] Continuation-in-part of Ser. No. 254,712, Jun. 6, 1994, Pat. No. 5,663,518.

[51] Int. Cl.[6] ..... B64D 1/02; B64D 1/147

[52] U.S. Cl. ..... 89/1.11; 244/136; 83/445; 83/346; 83/950; 83/913

[58] Field of Search ..... 89/1.11; 102/505; 244/136; 342/12, 9; 83/950, 445, 418, 949, 346, 347, 913

[56] References Cited

U.S. PATENT DOCUMENTS

| | | | |
|---|---|---|---|
| 3,027,047 | 3/1962 | Johnson | 221/30 |
| 3,339,201 | 8/1967 | Fischer et al. | 342/12 |
| 3,519,221 | 7/1970 | Kifor . | |
| 3,547,000 | 12/1970 | Haberkorn et al. | 89/1.5 |
| 3,693,487 | 9/1972 | Murdock et al. | 83/100 |
| 3,780,662 | 12/1973 | Sorenson | 342/12 |
| 3,873,290 | 3/1975 | Marzocchi | 83/346 |
| 3,971,277 | 7/1976 | Kowalski et al. | 83/176 |
| 3,987,966 | 10/1976 | Ruda et al. | 239/687 |
| 4,014,234 | 3/1977 | Spengler | 83/162 |
| 4,167,008 | 9/1979 | Blickenstaff . | |
| 4,218,944 | 8/1980 | Sclippa | 83/345 |
| 4,417,709 | 11/1983 | Fehrm | 244/136 |
| 4,538,490 | 9/1985 | Becker | 83/346 |
| 4,664,006 | 5/1987 | Mitchell | 83/341 |
| 5,140,880 | 8/1992 | Littleton | 83/98 |

OTHER PUBLICATIONS

Lundy AN/ALE–43(V) Chaff Countermeasures Dispenser Set, distributor, Jun. 7, 1993 at the Paris Air Slundy Technical Center.

"Mini–Chaff Cutter Dispenser For Tactical Aircraft", presented in Jan., 1990 to the United States Navy by Lundy Technical Center as Proprietary Data.

Lundy "New Chaff Mini–Cutter", distributed Jun. 7, 1993 at the Paris Air Show by Lundy Technical Center.

Hall et al., Theory and Problems of Machine Design, McGraw Hill, pp. 313–314. Date Jun. 1961.

*Primary Examiner*—Charles T. Jordan
*Assistant Examiner*—Christopher K. Montgomery
*Attorney, Agent, or Firm*—Steven J. Hultquist

[57] ABSTRACT

Apparatus and method for cutting and dispensing of adversarial interaction countermeasures, as for example chaff dipole elements for the self-protection of aerial vehicles against radar-guided missiles, providing substantially instantaneous in-flight cutting and dispensing of chaff dipole elements into the airstream along the flight path of aircraft, helicopters, and other aerial vehicles. The device comprises a drive motor assembly having a flywheel providing a motor inertia enabling the motor to maintain a substantially constant rotational speed when a load is applied for cutting of the material to be dispensed. Countermeasure articles that may be advantageously be cut and dispensed into an adversarial interaction area by the means and method of the invention include dipole elements which are interactive with radiation of varying character, e.g., infrared, microwave, ultraviolet, millimeter wave, etc., as well as less-than-lethal (LTL) adversarial interaction countermeasures.

18 Claims, 8 Drawing Sheets

METHOD AND DEVICE FOR CUTTING AND DISPENSING OF ADVERSARIAL INTERACTION COUNTERMEASURES

CROSS-REFERENCE TO RELATED APPLICATION

This application is a continuation-in-part of U.S. Pat. application Ser. No. 08/254,712 filed Jun. 6, 1994 now U.S. Pat. No. 5,663,518.

FIELD OF THE INVENTION

This invention relates to systems for cutting and dispensing of adversarial interaction countermeasures, as for example chaff dipole elements for the self-protection of aerial vehicles against radar-guided missiles, providing substantially instantaneous in-flight cutting and dispensing of chaff dipole elements into the airstream along the flight path of aircraft, helicopters, and other aerial vehicles. Other countermeasure articles that may be advantageously be cut and dispensing into an adversarial interaction area by the means and method of the invention include dipole elements which are interactive with radiation of varying character, e.g., infrared, microwave, ultraviolet, millimeter wave, etc., as well as so-called less-than-lethal (LTL) adversarial interaction countermeasures, utilized for warfare, domestic riot and crowd control, and animal capture for treatment or monitoring purposes.

BACKGROUND OF THE INVENTION

A conventional method for the self-protection of aircraft and the like from radar-guided missiles employs a chaff dispenser for ejecting chaff material in the form of pre-cut dipoles, or lengths of reflective or absorptive materials such as metallized glass or graphite fibers, into the airstream immediately along the flight path of the aerial vehicle. These pre-cut dipoles are cut and packaged at a factory in tubes or cartridges, typically made of a plastic, which are then placed in a dispensing device on the vehicles. One of more cartridges containing dipoles of a length selected in accordance with an expected radar frequency are fired from the dispensing device into the airstream where there is formed a cloud, or bloom, of the chaff which spoofs the radar and thereby provides protection of the vehicle.

There have also been used large bulk chaff dispensers that cut chaff dipoles in flight, but which are bulky, heavy and have a relatively slow response time. They could not be employed for self-protection, where a response time of one-tenth of a second might be considered too slow and five hundredths of a second (0.05 sec.) would normally be a minimum requirement. These bulk chaff dispensers have been used primarily for training and corridor seeding, and are not intended for self-protection.

While conventional pre-cut chaff systems have been found to be useful for enabling the self-protection of aircraft, they present a number of problems, and an improved self-protection device has been needed for some time. Therefore, the device of the present invention has been developed to overcome problems associated with such conventional pre-cut chaff systems.

A primary object of the present invention is a method and a device for the in-flight cutting and dispensing of chaff dipoles for use as self-protection device against radar-guided missiles.

A further object of the present invention is an in-flight chaff cutting and dispensing device with a reduced weight relative to conventional in-flight cutting systems, while still providing a fast response time and rapid chaff dipole dispense rate.

Another object is an in-flight chaff cutting and dispensing device which enables a significant increase in effective chaff use events, while providing increased reliability.

A further object is an in-flight chaff cutting and dispensing device providing flashless chaff ejection without the ejection of plastic parts into the air.

Still another object is an in-flight chaff cutting and dispensing device having a threat adaptable replaceable cutter roller and a threat capability over a wide range of radar frequencies.

A further object is the provision of an in-flight chaff cutting and dispensing device including a selectively variable cutting action for varying the dimensional characteristics, e.g., length, of the chaff elements.

Yet another object is the provision of a chaff cutting and dispensing device having the capacity to cut chaff into different lengths at the same time, so that the dispensed chaff comprises different length chaff elements.

An additional object is an in-flight chaff cutting and dispensing device providing a lower cost dispenser acquisition and a lower cost chaff payload.

Yet another object of the present invention is the provision of a means and method for the cutting and dispensing of a wide variety of adversarial interaction countermeasures, such as LTL countermeasures.

Other objects and advantages of the present invention will be apparent from the following description and appended claims.

SUMMARY OF THE INVENTION

The present invention relates to a device method for cutting and dispensing of an adversarial interaction countermeasure, such as for example chaff dipoles, LTL countermeasures such as sticky string or entanglement filament, etc.

In one aspect, the invention relates to a device for cutting and dispensing of countermeasure articles, e.g., chaff dipoles, into an airstream along the flight path of an aerial vehicle comprising:

(a) rotatable cutter and platen rollers opposing each other;

(b) a drive motor having a drive shaft and a flywheel affixed thereto enabling the motor to maintain a substantially constant rotational speed when the dispense mode of the device is initiated;

(c) a gear assembly for connecting the drive shaft to at least one of the rollers;

(d) a clutch assembly for coupling and de-coupling the drive shaft to the gear assembly in response to a signal; and (e) control means for outputting a signal to the clutch assembly so as to activate the operation of the clutch assembly and control the rotation of the cutter roller.

The cutting and dispensing device broadly described above may be constructed with the flywheel being sized to provide a motor inertia which enables the drive shaft to rotate at a selected speed substantially instantaneously after the gear assembly is coupled to the drive shaft. Such structure is highly significant, since it permits the response time of the cutting and dispensing device to be extremely short, as may be necessary under battlefield warfare conditions when virtually instantaneous dissemination of chaff is vital to the safety of the aircraft dispensing such chaff. Further, such flywheel arrangement and standby operational capability significantly relax power draw during the dispense operation, as another very important functional feature.

In another preferred embodiment, the present invention comprises the foregoing elements, further including a chaff roving storage compartment and a braking mechanism, enclosed in a housing, as well as a guide means for guiding chaff roving into the nip of the rollers. The resulting assembly may also comprise an opening in the bottom of the housing below the rollers and a movable bottom cover/spoiler for alternately covering the opening when the device in not in use and serving as a spoiler to enable the exit of the dipoles into the airstream.

Another aspect of the invention relates to a roving filament cutting and dispensing device including opposed platen and cutter rollers, in which the cutter roller has multiple transversely discrete surface areas along an axial extent of its surface, of differing bladed character, and means for selectively guiding roving filament to a selected one or ones of the multiple transverse discrete surface areas for cutting thereon, to produce a cut filament for dispensing. In a further variation of such aspect, the guide means may be operatively coupled to sensing means for detecting a threat condition and responsively selectively guiding roving filament to said selected one or ones of the multiple transverse discrete surface areas for cutting thereon.

Another aspect of the present invention relates to a method of providing self-protection for an aerial vehicle, e.g., against hostile radar and radar-mediated action, which method comprises:

(a) providing on the vehicle, e.g., by mounting or placement on a component structure or subassembly thereof, a chaff cutter/dispenser mechanism for cutting chaff roving into chaff dipoles of a preselected length and dispensing the dipoles into an airstream along the flight path of the vehicle in response to a dispense signal;

(b) transmitting a dispense signal to the cutter/dispenser mechanism to activate the cutter/dispenser mechanism; and (d) cutting the chaff roving into the chaff dipoles and dispensing the chaff dipoles directly into the airstream.

The foregoing method may further be integrated with a condition-sensing means for sensing an adversarial interaction condition, e.g., detecting a hostile radar signal while the vehicle is in flight; so that the adversarial interaction condition is sensed, and in response thereto, a dispense signal is transmitted to the chaff cutting and dispensing device.

Another aspect of the invention relates to a method for defensive deployment of a radar-interactive chaff from an aerial platform, e.g., a plane, missile, dirigible, balloon, glider, etc., such method comprising the step of dispensing a continuous length of chaff filament from the aerial platform during flight, to trail from the aerial platform and generate a misrepresentative radar signature of the aerial platform. The trailed chaff may be thus deployed for as long as a threat condition is or may be extent, and thereafter the trailed chaff filament may be severed from the aerial platform.

Alternatively, such chaff filament trailing method may be practiced from a terrestrial or marine vessel, during its travel.

Various other aspects and features of the invention will be more fully apparent from the ensuing disclosure and appended claims.

BRIEF DESCRIPTION OF THE DRAWINGS

The present invention will be described hereinafter with reference to the accompanying drawings, wherein like numbers designate like elements and wherein.

DESCRIPTION OF PREFERRED EMBODIMENTS OF THE INVENTION

While the invention is hereafter specifically described in terms of chaff as the material with which the apparatus and method of the present invention is utilized, it will be recognized that the invention may be employed to cut and dispense a wide variety of other materials, as "countermeasure articles." Such countermeasure articles may include the LTL articles hereinabove referred to, as well as any other means and materials which may be cut into discrete segments, sections, particles, or other subdivided form, and dispensed into a locus of interaction in which the countermeasure may be useful, e.g., for combating activity, events or measures directed at or against persons, vehicles, installations, etc.

The invention is applicable to various LTL countermeasures, which are emerging as effective means for capturing, controlling, and/or subduing persons in areas of conflict, including domestic and civilian disturbances, criminal activity, adversarial interactions in battlefield conditions and warfare generally. The invention is also applicable to the production and dispersal of chaff articles for decoy and anti-detection applications, in various regimes of the electromagnetic spectrum, including radio, UV, IR, millimeter wave, UHF and other radiation-interactive deployments.

Further, while the invention is described primarily with reference to applications in aerial vehicles, including vehicles such as fighter aircraft, cargo, surveillance and refueling airplanes, missiles, aerial bombs, etc., the utility of the invention is not thus limited but extends to a wide variety of other placements and utilizations, including terrestrial fixed and mobile emplacements, space vehicles and extra-terrestrial locations, surface marine and underwater areas, and ambulatory manually operated deployments.

Figure 1:
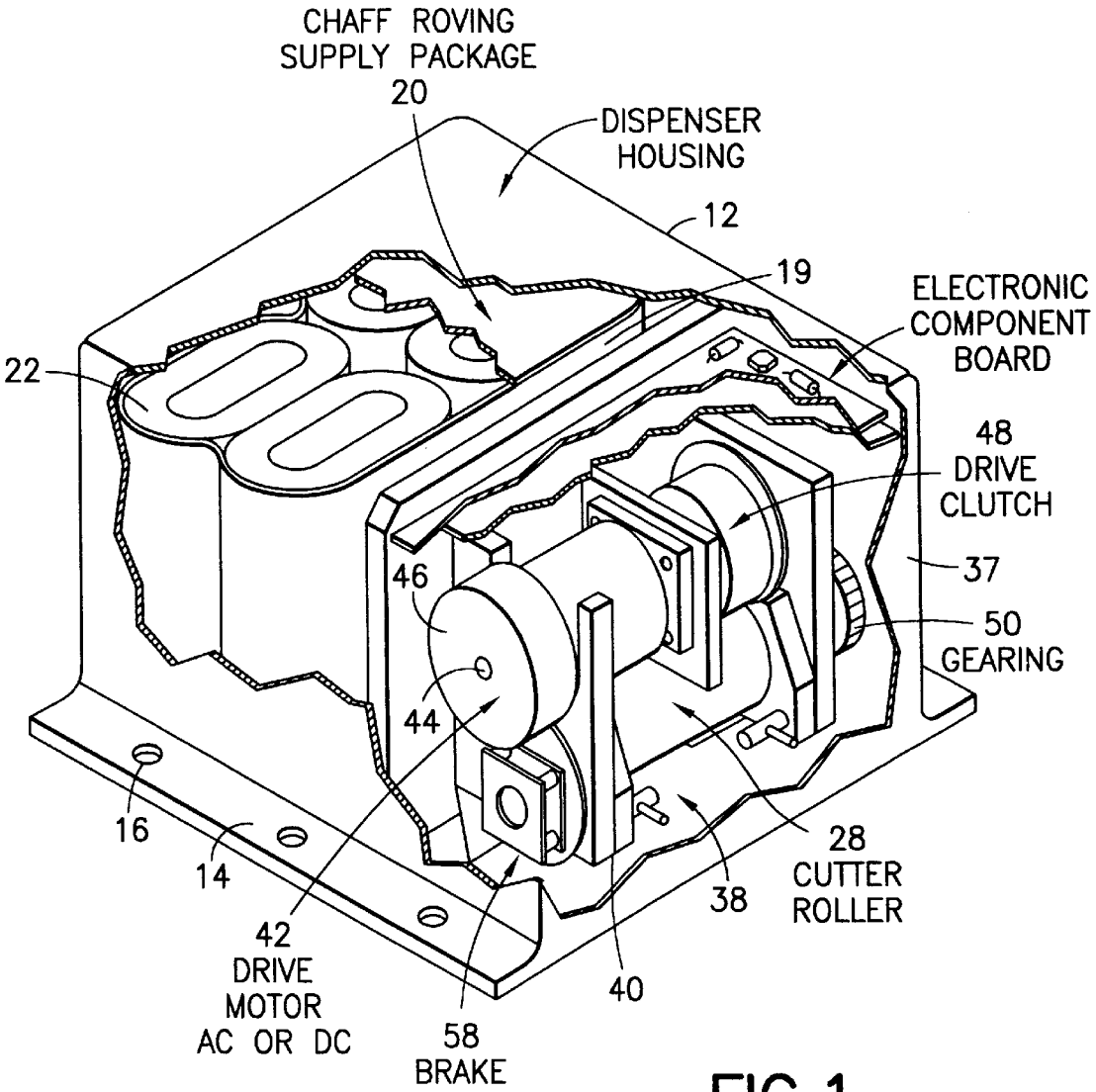
FIG. 1 is a perspective view illustrating a preferred embodiment of the present chaff cutter/dispenser, wherein the dispenser housing is partially cut away.
Figure 2:
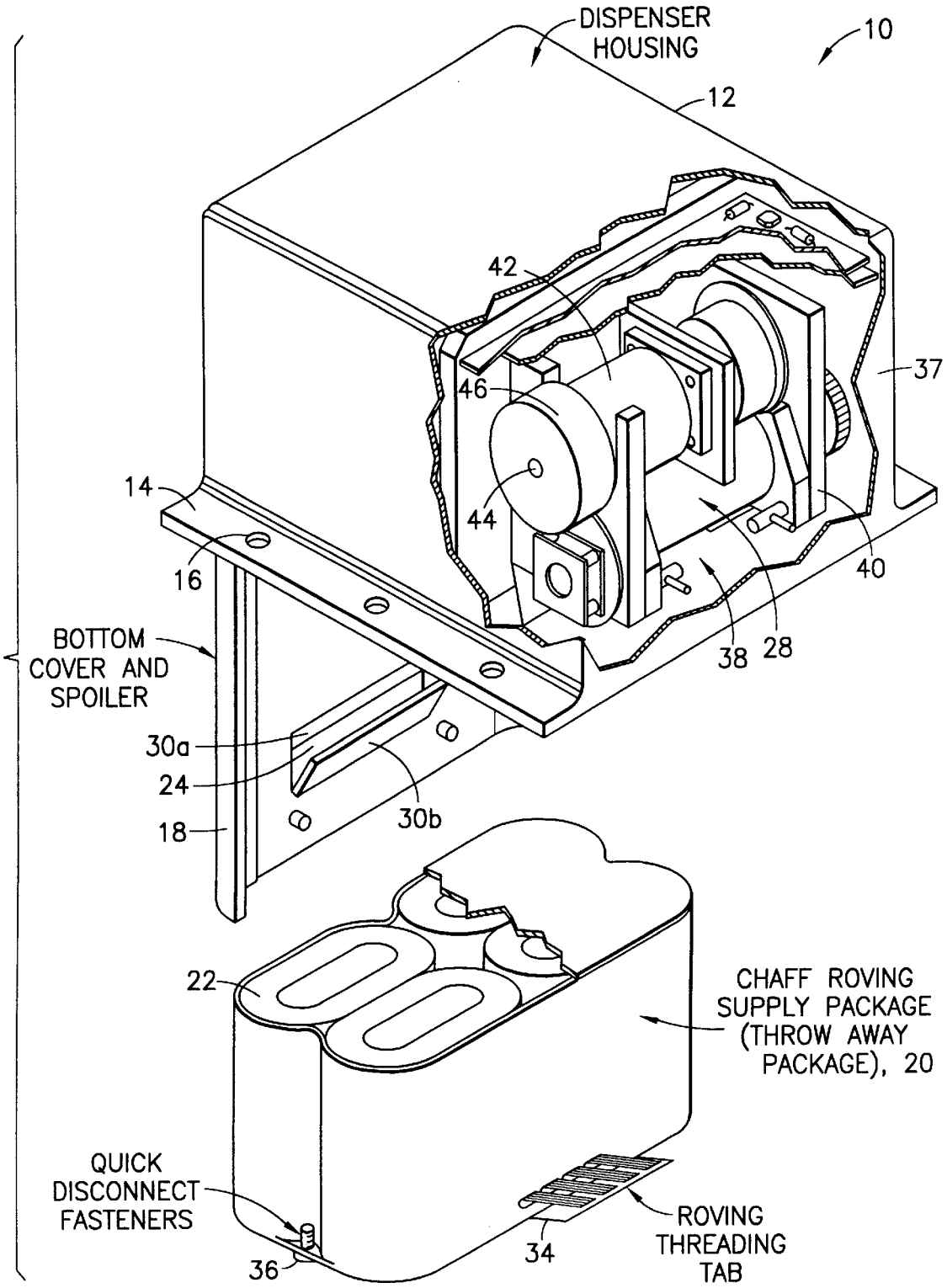
FIG. 2 is a perspective view of the cutter/dispenser of FIG. 1 illustrating a chaff roving supply package to be inserted in the device of the present invention.

Referring to FIGS. 1 and 2, the chaff cutter/dispenser 10 comprises a housing member 12 having a flanged lower portion provided with openings 16 enabling the cutter/dispenser 10 to be attached with fasteners to an appropriate support located, for example, in the aft section of an aircraft fuselage (not shown). The housing member 12 is provided with a bottom cover 18 attached by hinges to the housing member so that roving material, e.g., chaff, supply packages 20 containing multiple, e.g., four, helically wound bundles 22 of roving (fibers twisted into flat, rope-like strands) may be readily inserted into and removed from the roving storage compartment 19 through access port 17. The bottom cover 18 is provided with an elongated opening 24 extending along the length of and located below platen roller 26 and cutter roller 28, shown in FIGS. 3 and 4, so that cut material articles, e.g., chaff dipoles, fall through the opening and exit the housing 12. Inwardly extending wall members 30*a* and 30*b* on the forward and aft sides of the opening 24 assist the cut material articles in exiting the housing 12, and a spoiler member 32, shown in FIG. 4, positioned outside the bottom cover 18 and extending along the forward side of the opening 24, assists in dispensing the cut material articles into the airstream along the flight path of the aircraft. In a preferred arrangement, the spoiler 32 is retractable to a flush position, closing off opening 24, when the dispenser is not in use.

As shown in FIG. 1, the roving material supply package 20, which is a removable roving material storage module, contains a plurality, e.g., four roving material bundles 22 each having an elliptical cross section to provide a more space effective package. The rovings, shown as 23 in FIG. 3, in the case of chaff articles, preferably are formed of twisted strands of glass fiber of about 1 mil diameter coated with aluminum or another suitable metal, graphite fibers or other suitable materials providing the desired reflection or absorption of radio frequency energy. Such materials and their method of manufacture are well-known in this art. As shown in FIG. 2, the leading end of each of the strands of roving may be provided with a thin, flat roving threading tab 34 to facilitate the threading of the roving into the nip of rolls 26 and 28 when a fresh roving supply package 20 is inserted into the dispenser/cutter 10. The roving package 20 is fitted with quick disconnect fasteners 36 which communicate with mating members (not shown) in housing 12 to facilitate the quick replacement of the supply package when the roving therein is exhausted.

Figure 4:
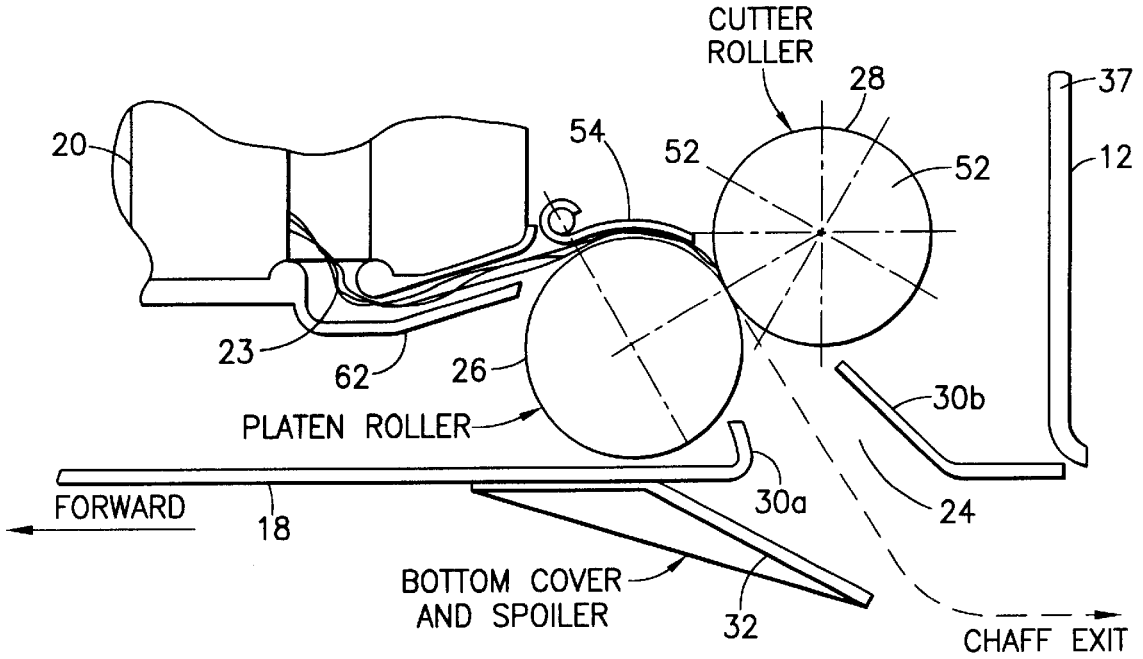
FIG. 4 is a sectional end view of the device of the present invention in the cutting position.

Referring to FIG. 4, a guide means 62 is positioned beneath the roving compartment 19 and upstream of the rollers 26 and 28. The guide means 62 comprises a plurality, e.g. four, tubular members for guiding the rovings 23 from the roving material supply package 20 to the nip of rollers 26 and 28. When a fresh roving supply package 20 is inserted into compartment 19 the roving ends, which extend from a lower portion of the roving material supply module 20, are pulled from the supply module and the threading tab 34 of each roving is threaded into the nip of rollers 26 and 28, so that when the rollers are rotated the rovings are drawn between the rollers from the interior of each of the wound material bundles 22 through the guide means 62.

With continued reference to FIGS. 1 and 2, within the housing 12 and aft of wall 37 there is positioned a cutting mechanism 38 mounted on a support member 40 secured to the housing. The cutting mechanism comprises a drive motor 42 having a drive shaft 44 and a flywheel 46 affixed to the rotor of the drive motor. The inboard end of drive shaft 44 is connected to the rotor (clutch face) of a drive clutch assembly 48, while the stator (electromagnetic clutch) of the clutch assembly is connected to a gear assembly 50 for driving each of the cutter roller 28 and the platen roller 26 shown in FIGS. 3 and 4, to cause the opposing rollers to rotate in opposite directions. A gear reducer (not shown) may be used between the drive shaft 44 and the clutch face to reduce the speed to the desired speed, typically about 5000 r.p.m. in the case of chaff fiber production. Advantageously, the gear reducer is positioned on the drive shaft inside the motor housing.

Figure 3:
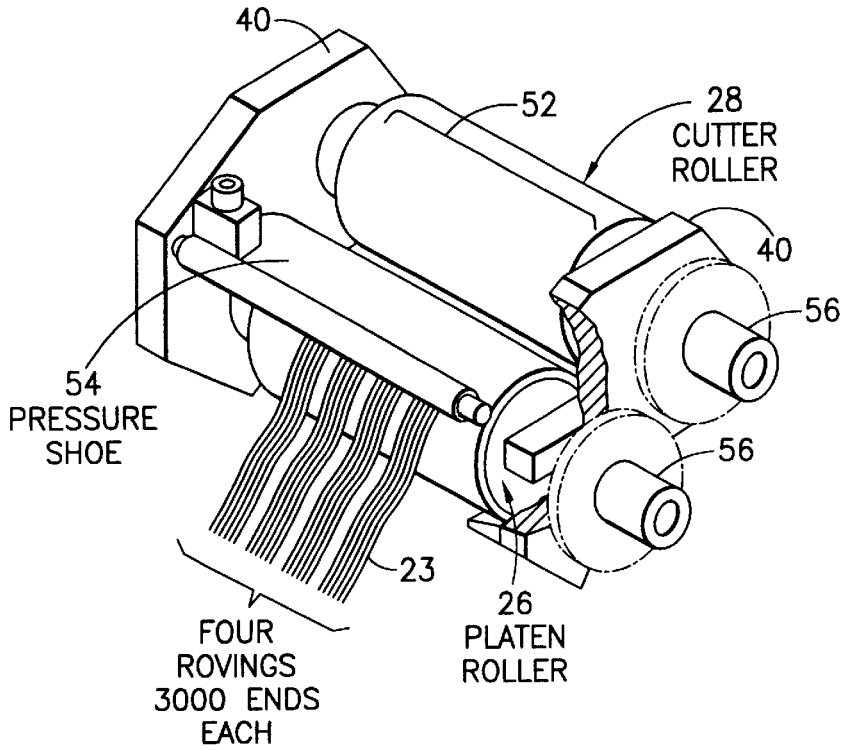
FIG. 3 illustrates a platen and roller assembly for use in the present invention.

The platen roller 26, shown in FIGS. 3 and 4, preferably is formed of rubber or another suitable elastomer, while the cutter roller 28 typically is formed of steel or another suitable material and has a plurality of cutter blades 52, shown in FIGS. 3 and 4, extending along the length of and spaced around the circumference of the roller 28 for cutting the strands of roving to a suitable length, which may for example in the case of chaff fibers depend on the expected frequency of a threat radar. The knife-edge blades 52 are mounted in precisely machined grooves spaced around the circumference of the cutter roller, and the cutter roller may be constructed in a manner well-known in the art. A pivotable pressure shoe 54, shown in FIGS. 3 and 4, extends the length of the platen roller 26 for maintaining a slight pressure on the strands of roving drawn into the nip of rolls 26 and 28. Means may be provided for adjusting pressure of the blades 52 against the surface of the platen roller 26 to provide platen pressure optimization.

Referring to FIG. 3, the platen roller 26 and the cutter roller 28 are held in the support member 40 by fasteners 56 which can be easily removed when it is desired to replace the rollers. FIG. 3 shows four rovings 23, which in the case of chaff typically have about 2,000 to 3,000 ends each, passing under pressure shoe 54 into the nip of rollers 26 and 28, and as roller 28 rotates each of the blades 52 presses the rovings against roller 26 with sufficient force to cut the rovings into appropriate lengths, e.g., as chaff dipoles or other cut material articles, to produce cut lengths of the fibers forming the roving. Thus, in the case of chaff production, as the roving is cut, thousands of dipoles are formed. The spacing of the blades around the circumference of roller 28 will determine the length of the dipoles cut, and a number of replacement cutter rollers 28 may be supplied to enable the cutting of dipoles of varying lengths merely by changing the cutter roller. For example, the dipoles may be cut into lengths ranging from 5 inches down to 0.06 inches, by selecting the appropriate cutter roller. In this manner, dipoles of the appropriate length can be cut and dispensed as a countermeasure for a wide variety of radar frequencies, e.g., from 1 to 100 GHz.

As shown in FIG. 1, the drive motor 42, supported on support member 40, has a drive shaft 44 with a flywheel 46 secured to the outboard end, and the inboard end of the drive shaft 44 is keyed to the rotor of the magnetic clutch assembly 48 which may be activated upon receipt of an electrical signal to engage with gear assembly 50 to rotate rollers 26 and 28, shown in FIGS. 3 and 4. Preferably, the gear assembly comprises a reduction gear in order to rotate the rollers at the desired speed, typically, about 3600 r.p.m. The details of such gears and their connections to the drive shaft and the rollers are well understood by those working in the mechanical arts and require no elaborate detail herein.

In use of the device of FIGS. 1–4 for cut chaff production during a flight of an air vehicle equipped with such device, drive motor 42 runs continuously, without a load applied, in a standby condition, and when a radar threat occurs a signal sent to the clutch assembly 48 activates the magnetic clutch to cause the motor 42, through the gear assembly 50, to rotate rollers 26 and 28 which draw the rovings into the nip and cut the dipoles to a length determined by the spacing of blades 52.

In order for the device of the present invention in a chaff application to provide in-flight self-protection, and cut and dispense chaff dipoles in a substantially instantaneous manner, the inertia of motor 42 should be great enough so that when the load is placed on it, i.e., rotation of the clutch stator (electromagnetic clutch) is accelerated, the gears turn and the rollers rotate to cut the chaff roving, the motor continues to turn at substantially the same rotational speed as when in the standby condition. Thus, when use of the chaff cutter/dispenser is initiated by a signal to the clutch assembly dipoles of chaff are cut, fall through opening 24, and are dispensed into the airstream substantially instantaneously. Preferably, the motor is designed (sized) to produce an inertia of sufficient magnitude to provide a substantially instantaneous response time, e.g., on the order of about 40 milliseconds or less, i.e., the cutter roller begins rotating and cutting the chaff roving into dipoles and the cutter roller is brought up to full operating speed, e.g. about 3600 r.p.m., within about 40 milliseconds after receipt of a dispense signal to the clutch assembly.

In the present invention, this substantially instantaneous response time, permitting in-flight self-protection, is obtained through the combination of a suitable electric motor having a sufficiently low continuous power consumption, and a flywheel which is constructed and arranged to provide a motor inertia which enables the drive shaft to rotate at the desired speed substantially instantaneously after the gear assembly is coupled to the drive shaft. By contrast, the use of an electric motor alone to provide substantially instantaneous response time would require an exorbitant power consumption, inconsistent with an aircraft environment.

Substantially instantaneous, as used herein in respect of the response time of the cutter/dispenser device of the invention, refers to a response time less than five one-hundredths of a second (0.05 sec.).

In an illustrative embodiment of the invention, the cutter/dispenser device may be constructed and arranged with an electric motor having the following performance and size specifications:

| 115/208 v. 400 Hz. 3 phase | |
|---|---|
| Speed | 4950 rpm rated<br>(after reduction - 19,800 rpm internally) |
| Torque | 10.8 in lbs. rated |
| Horsepower | 0.85 |
| Inertia | $150 \times 10^{-4}$ lb. in sec$^2$ |
| Diameter | 2.25" to 2.75" |
| Length | 3.25" to 3.50" |
| Shaft | 0.5" diameter × 0.75" to 1.00" long |
| Weight | 3 lbs. maximum |

The required motor inertia is provided by the flywheel 46 on the drive shaft 44, rotating at 19,800 rpm with the motor. When an electric motor having the required inertia characteristics is used in combination with the electromagnetic clutch and the reduction-type gear assembly, a fast response time, as for example approximately 40 milliseconds, can be achieved. Without the flywheel, an electric motor of approximately 3.40 horsepower, four times larger, would be required to achieve an equivalent response time.

If desired, a braking mechanism 58, for example a friction-type brake, positioned on the outboard end of the shaft of cutter roller 28, or both rollers 26 and 28, may be used to reduce the rotational speed of the cutting mechanism when the chaff cutter/dispenser is switched from the operating mode to a standby mode.

Figure 5:
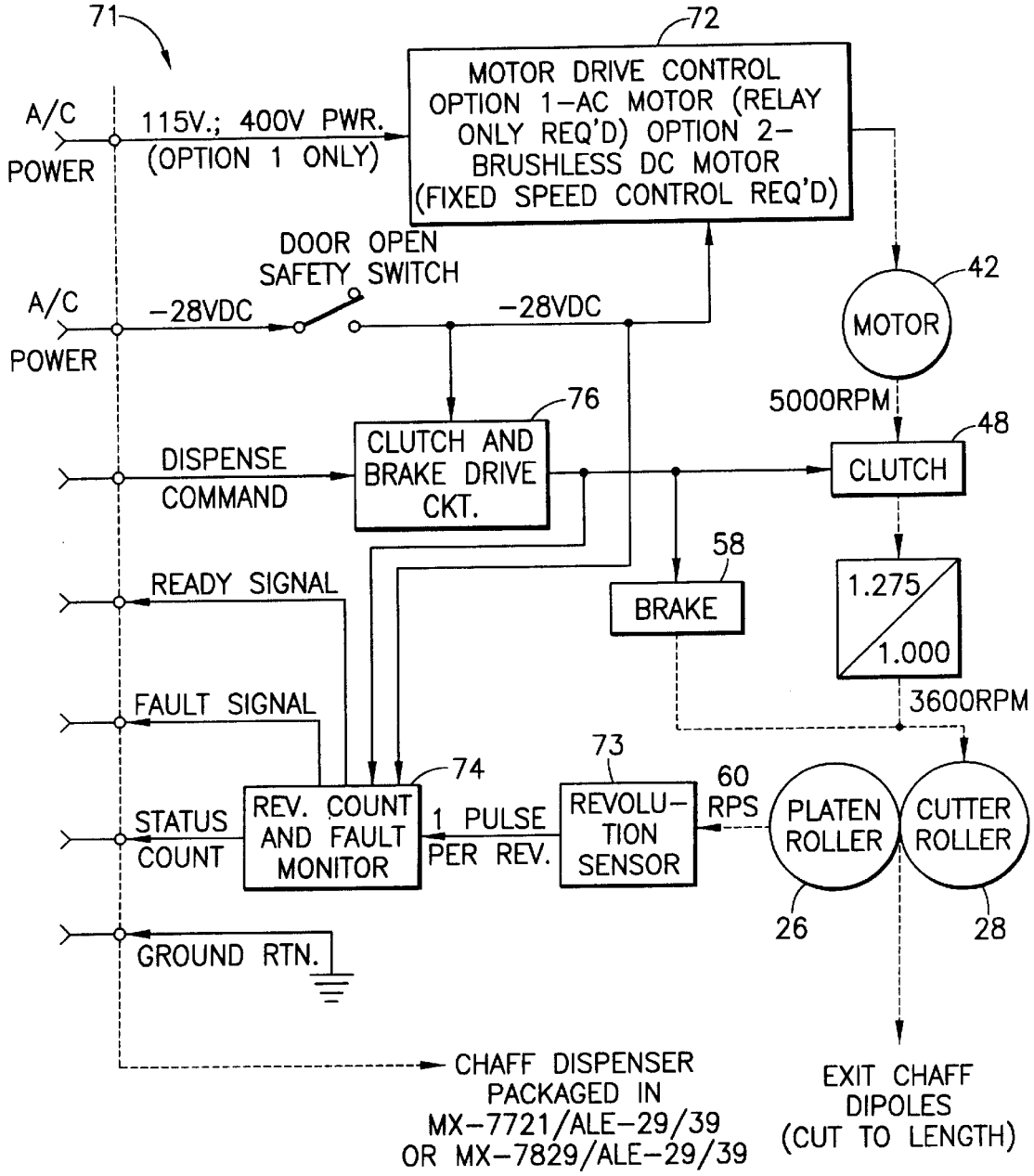
FIG. 5 is a functional block diagram of the cutter/dispenser mechanism of the present invention and an electronic interconnection box for receiving command signals.
Figure 6:
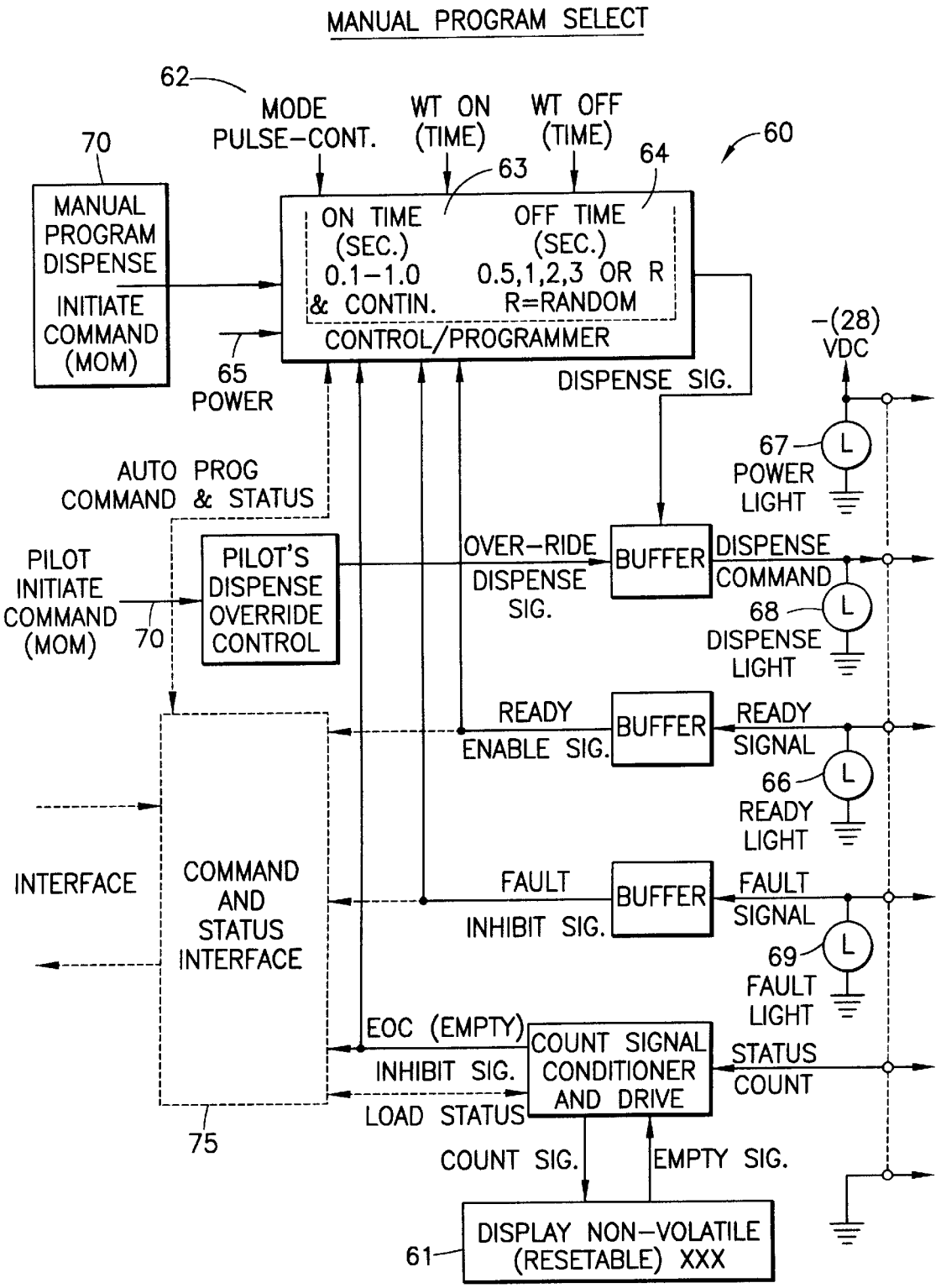
FIG. 6 is a functional block diagram of the electronic control system for directing the operation of the present chaff cutter/dispenser.
Figure 7:
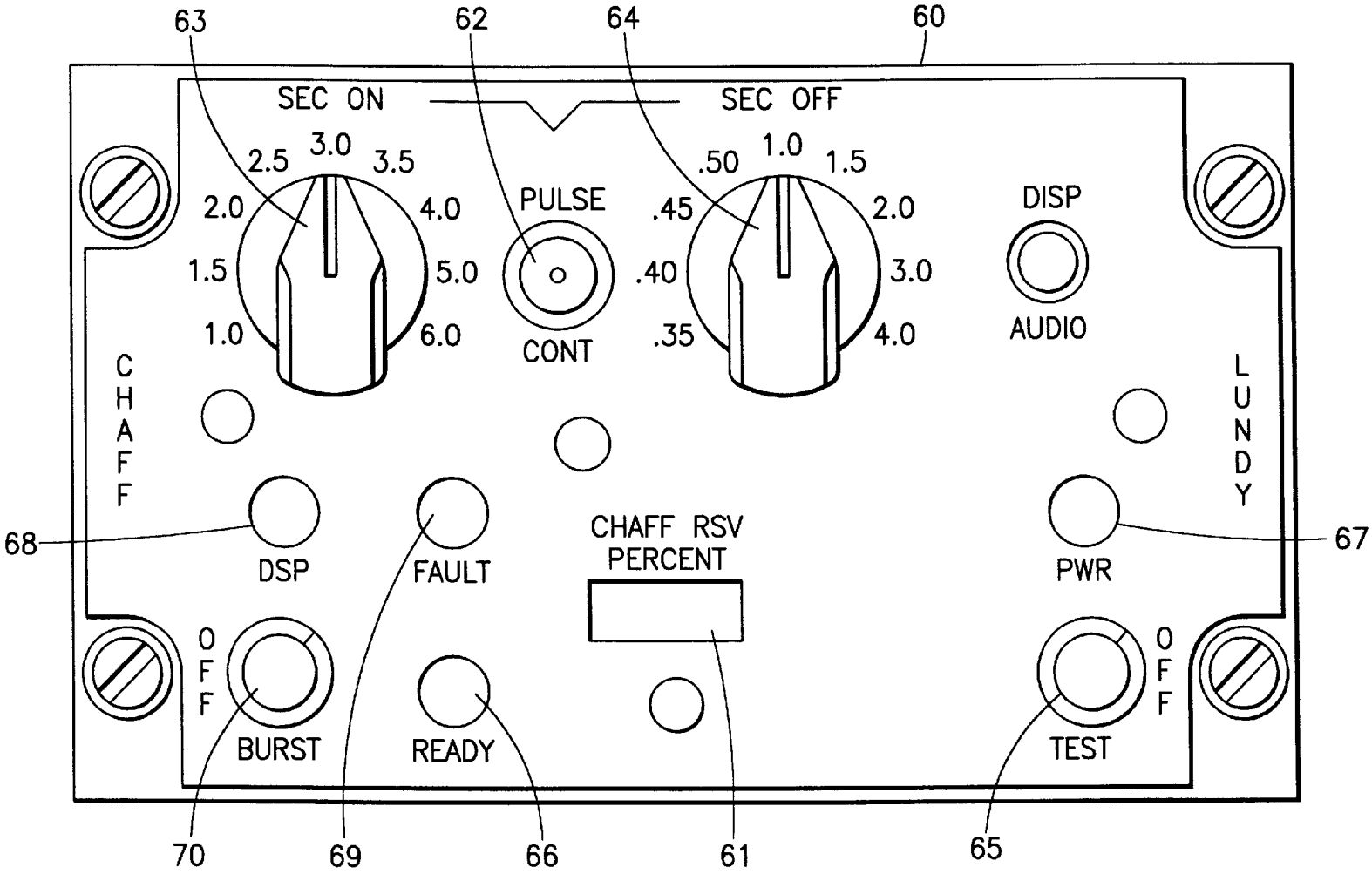
FIG. 7 is a front view of the panel of a control box of the device of the present invention.

Referring to FIGS. 5, 6 and 7, a control means 60, which includes a switching device, electrically connects an electric power supply to the drive motor 42, the clutch assembly 48 and brake mechanism 58 and outputs signals to each of these components to activate and/or deactivate the operations thereof and control the rotation of the cutter roller 28 and/or the platen roller 26.

Referring to FIGS. 5 and 6, the cutter/dispenser control means comprises a control box 60 connected to an interconnection box 71 and is used to perform the manual control of the cutting mechanism 38. In lieu of manual control means, automatic control means could be suitably employed. The initial setting is to position counter 61, a material reserve counter used for indicating the percentage of material remaining in the material supply compartment, at a reading of 100. This indicates that the payload is at 100% capacity.

A mode switch 62 selects the operating mode, which may be continuous or pulse. If the continuous mode is selected the dispenser will dispense cut material articles without interruption until the counter 61 indicates zero. At that time the machine will automatically shut off.

When the pulse mode is used ON 63 and OFF 64 times are selected on the control panel so that the cutter/dispenser operates in cycles having a range from 0.10 sec to 1.00 sec for ON and from 0.35 sec to 4.00 sec for the OFF timer.

The circuitry for the ON-OFF timing is located on a printed circuit board in the control box 60.

The other controls on the Control 60 box are:

(a) Power Switch 65—When the power is applied the mechanism drive motor 52 comes up to speed, typically about 5000 rpm. When the motor is up to speed the Ready annunciator light 66 will illuminate, indicating that the dispenser is ready to dispense cut material when so commanded.

When the power is applied an annunciator light 67 above the power switch 65 will be illuminated. The power switch test position (down) tests all annunciator lights.

(b) Dispense Switch 70—When the dispense switch is activated in the up position the mechanism will dispense cut material in the fashion selected by the mode switch 62 and the ON-OFF settings. The annunciator light 68 will illuminate during the actual dispensing period. The down position of the dispense switch 70 allows the ejection of a single cut material burst. The duration of the burst can be set at the factory. A fault light 69 will illuminate if the dispenser fails to dispense cut material at the required rate.

Electronic interconnection box 71 takes the commands from the control box 60 and transforms them into signal usable by the mechanism 38 to perform the required functions.

The power ON command 65, causes the switching of a relay 72, thereby applying the drive power to the motor 42.

The dispense command 70 causes the application of power 76 to the brake 58 to release the cutter roller and to the drive clutch 48 to drive the cutter roller 28 and platen roller 26.

A magnetic revolution sensor 73, located on the cutter roller shaft counts the number of shaft revolutions. This signal is processed 74 and used to generate the chaff reserve counter 61 reading on the Control box 60.

The electronic interconnection box 71 may be modified to receive signals from an AN/ALE-39, AN/ALE-40 or AN/ALE-47 Programmer 75 to generate the command to the cutter/dispenser mechanism to provide the appropriate cut material dispensing response. Such programs are well-known in the art and require no detailed description herein.

The above-described cutter/dispenser enables a compact, lightweight, fast response chaff cutter/dispenser which, when compared to conventional chaff dispensing systems, has been found to provide a five- or six-to-one increase in effective chaff use events, with up to 60 break lock events obtained from only 2 kg. of chaff. It provides a rapid response (40 milliseconds) to a radar threat and can dispense chaff dipoles of a selected length in a continuous or pulse mode.

Figure 8:
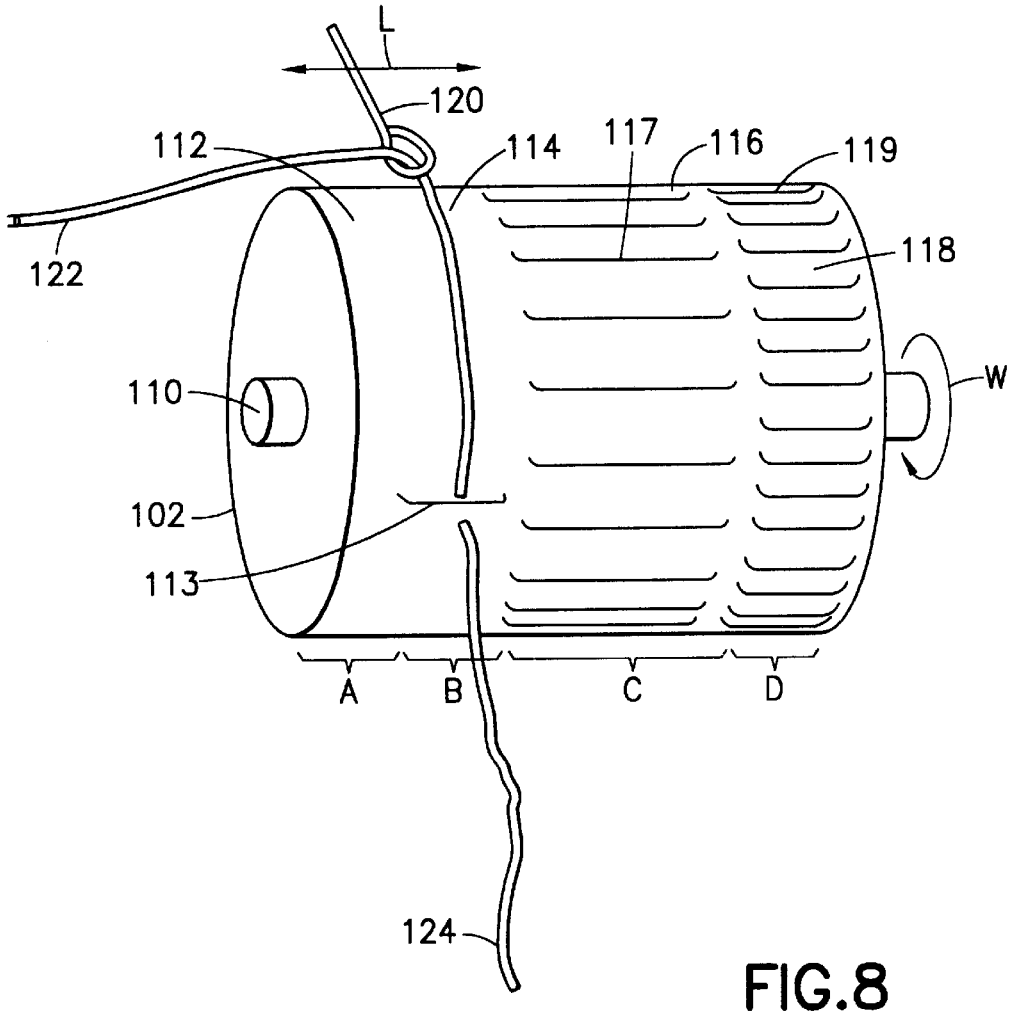
FIG. 8 is a schematic perspective view of a cutter roller and roving shutter assembly according to one embodiment of the invention for cutting filamentous countermeasure articles of varying length.

FIG. 8 is a schematic perspective view of a cutter roller and roving shutter assembly according to one embodiment of the invention for cutting filamentous countermeasure articles of varying length. In this embodiment, the cutter roller 102 (shown here without the associated platen roller for purposes of clarity) is mounted for rotation on axle 110. The axle in turn is coupled with suitable drive means (not shown) for rotation of the cutter roller in the direction indicated by arrow W.

The roller cutter 102 has an outer cylindrical surface including four surface area zones A, B, C and D. Surface area zone A comprises smooth roll surface 112 which is devoid of any cutter blades thereon. Surface zone B comprises surface 114 having the single blade element 113 thereon. Surface zone C comprises surface 116 having a multiplicity of circumferentially spaced-apart blade elements 117 thereon. Surface zone D comprises surface 118 having a multiplicity of circumferentially spaced-apart blade elements 119 thereon. As illustrated, the blade elements 117 of zone C are significantly more spaced apart from one another than are the blade elements 119 of zone D.

The roller cutter 102 is disposed in operative relationship with a roving filament guide 120 which is arranged to be selectively driveable (by drive means not shown) in the axial direction in either of opposite directions indicated by the bi-directional arrow L. The roving filament 122 is passed through the loop member of the guide 120 which is maintained as illustrated in the drawing above the surface 114 of zone B. As the roller cutter 102 is rotated in the direction of arrow W, the roving filament (disposed between the surface of the roller cutter and a complementarily positioned platen roller, not shown) is severed by the blade element 113 to produce the cut roving filament 124 for discharge from the cutting locus.

It will be appreciated that if the guide 120 is subsequently translated in the left-hand direction and then reposed above the surface of zone A, which is devoid of blade elements, the roving filament will not be severed at all, but rather will continue to be discharged from the cutter roller/platen roller assembly as a whole filament of continuous length. In such conformation of the system, filament is dispensed as a continuous roving with the guide 120 in the non-cutting position. When the desired length is generated, the mechanism dispense mode is terminated without cutting the roving free. This permits the dispensing aircraft or other dispenser structure to "trail chaff" and tow a trailing length of radar-interactive material, creating the impression and confusion of a large target to monitoring radar, and enhancing the ability of the "trailing" aircraft to evade radar-directed anti-aircraft fire, surface to air missiles, etc. Upon cessation of the threat to the aircraft, the guide 120 can be translated rightwardly over zone B to cut loose the trailing chaff.

The cutting roller of FIG. 8 permits the capability to cut chaff dipoles of varying length, by appropriately translating the guide 120 over the selected one of the zones A, B, C and D, to resulting sever the roving filament to the desired length. Thus, the roving filament may be severed on surface 116 by the blade elements 117 by positioning the guide 120 over surface zone C, or on surface 118 by the blade elements 119 by positioning the guide 120 over the surface zone D. In this manner, controlled lengths of chaff filament can be generated to respond to radar or other radiation of varying frequency, longer dipole lengths being useful against low frequency radars and shorter dipole lengths being useful against higher frequency radars.

The guide 120 may be suitably automated by appropriate control and translation mechanisms operatively coupled with suitable hardware/software systems, and functionally arranged to be responsive to sensed radar or other signals, so that chaff of appropriate dipole length is generated. Thus, the system shown in FIG. 8 can be arranged to respond in real time to a detected radar frequency, to maximize countermeasure activity.

Figure 9:
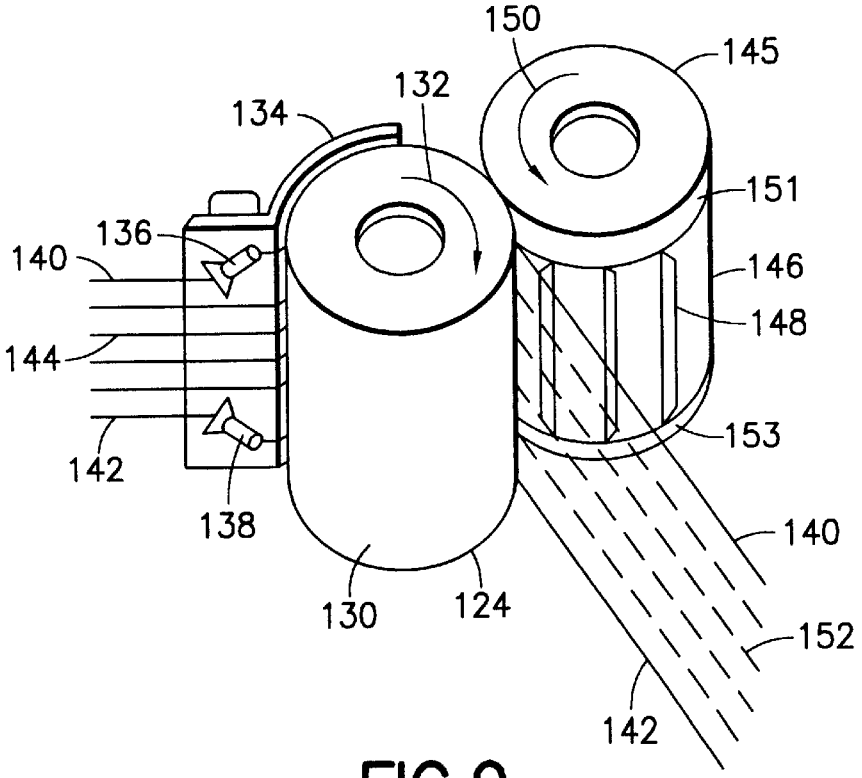
FIG. 9 is a schematic perspective view of a platen roller and cutter roller assembly according to a further embodiment of the invention, arranged for simultaneously cutting long and short length countermeasure articles.

FIG. 9 is a schematic perspective view of a platen roller 124 and cutter roller 145 in an assembly according to a further embodiment of the invention, arranged for simultaneously cutting long and short length countermeasure articles. As shown, the platen roller 124 has a smooth cylindrical outer surface 130 and is driven (by suitable drive means, not shown in FIG. 9) in the direction indicated by arrow 132. The platen roller is in bearing relationship against the cutter roller 145. The cutter roller 145 has a cylindrical outer surface 146 on which are mounted an array of blade elements 148, each of which is circumferentially spaced-apart from adjacent blade elements in the array. The cutter roller 145 is driven (drive means not shown) in the direction indicated by arrow 150.

The platen roller 124 is operatively positioned with the pressure shoe in proximity thereto as shown, to provide a guide structure to the multiple roving filaments being introduced to the platen roller. The multiple roving filaments comprise outer filaments 140 and 142, and intermediate filaments 144. The outer filament 140 is directed by roving guide 136 to an outer unbladed margin surface area 151 of the cutter roller and the outer roving filament 142 is directed by the roving guide 138 to the unbladed margin surface area 153 of the cutter roller. The intermediate filaments pass onto the medial bladed surface of the cutter roller, and are cut into chopped lengths 152, while the outer filaments 140 and 142 remain whole and uncut.

Figure 10:
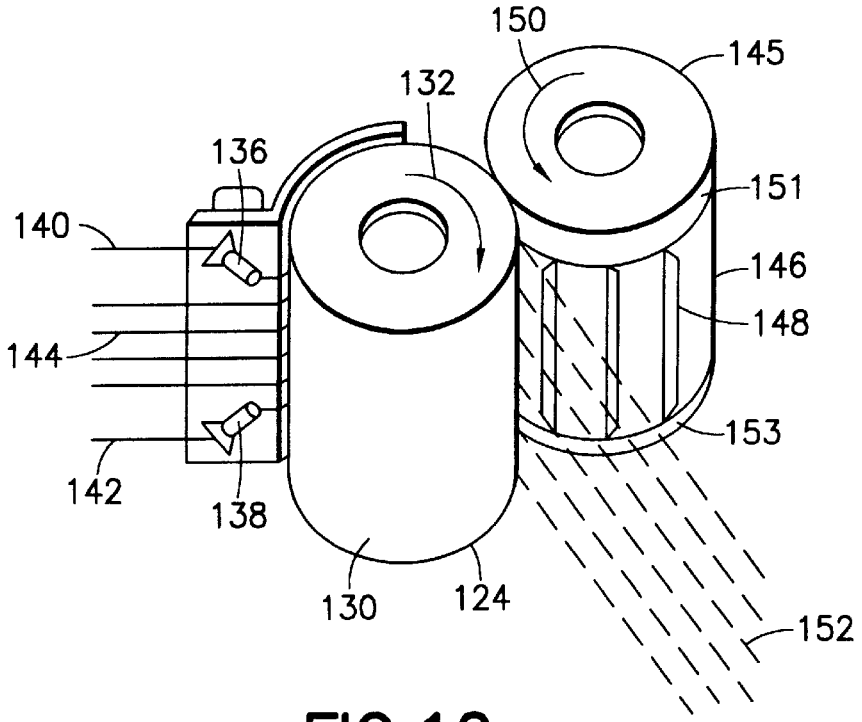
FIG. 10 is a schematic perspective view of the platen roller and cutter roller assembly of FIG. 9, arranged for cutting uniform length countermeasure articles.

In FIG. 10, the same system is shown, but with the roving guides 136 and 138 rotated so that the outer filaments 140 and 142 are directed onto the bladed surface of the cutter roller so that all filaments are cut into chopped lengths 152 as shown.

It will be appreciated from the foregoing that roving guides may be employed to simultaneously cut respective roving filaments into different lengths so that the dispensed chopped filaments have a distribution of dipole lengths, to accommodate mixed frequency radar, or multiple radars each of a different frequency characteristic.

Figure 11:
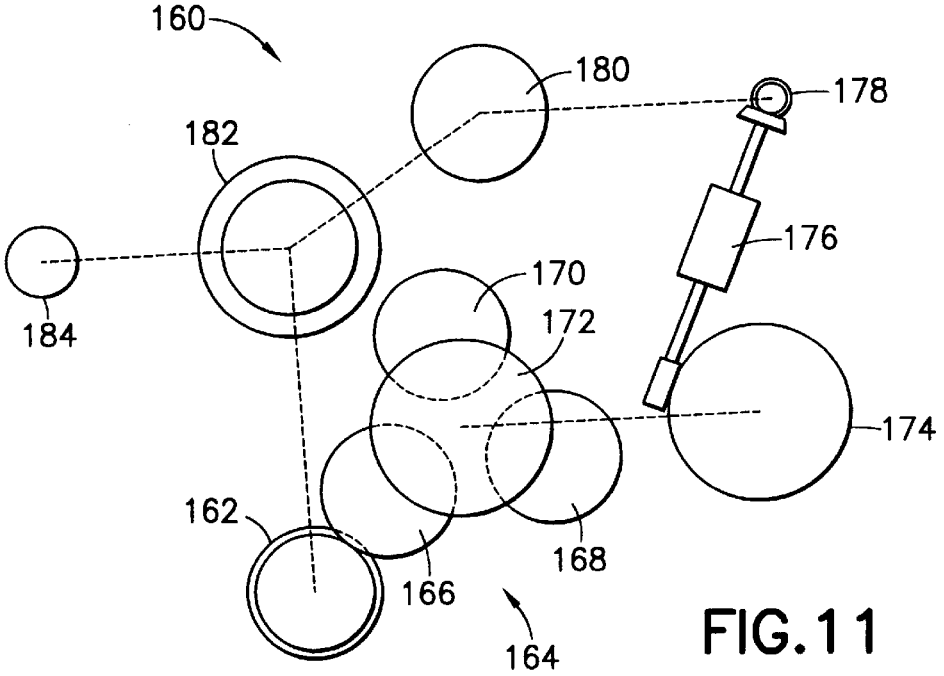
FIG. 11 is a schematic side elevation view of a countermeasure cutting and dispensing assembly comprising a turret mounting multiple cutter rollers thereon, which are individually selectively registerable with the platen roller for the cutting of countermeasure articles of varying lengths.

FIG. 11 is a schematic side elevation view of a countermeasure cutting and dispensing assembly 160 comprising a carousel 164 including a turret 172 mounting multiple cutter rollers 166, 168 and 170 thereon, which are individually selectively registerable with the platen roller 162 for the cutting of countermeasure articles of varying lengths. Thus, the carousel 164 may be selectively rotated to bring a selected one of the multiple cutters 166, 168 and 170 into position for cutting of the roving filament, each of such cutters 166, 168 and 170 having a different blade element conformation (e.g., a differing circumferential density of blade elements), so that flexibility in cutting roving filaments to a selected lengths from among various candidate lengths is permitted.

In the FIG. 11 system, the cutter roller carousel is motively coupled with a turret indexing drive 174 connected to an index clutch-brake 176. The index clutch-brake is joined to a miter gear 178, which is motively coupled to the drive motor 180. The drive motor and platen roller are operatively interconnected with the clutch 182 which in turn is coupled with the brake 184. By this arrangement, the carousel may be selectively operated for indexation with the cutter roller to controllably generate cut filament of a selected length character.

Although the invention has been described herein with reference to various specific embodiments and illustrative features, it will be recognized that the invention is not thus limited, and that variations, modifications and other embodiments are contemplated, so that the invention is to be broadly construed as encompassing within its spirit and scope all such variations, modifications and embodiments.

What is claimed is:

1. A device for cutting and dispensing of countermeasure articles, comprising:

(a) rotatable cutter and platen rollers opposing each other;

(b) a drive motor having a drive shaft and a flywheel affixed thereto enabling the motor to maintain a substantially constant rotational speed when a dispense mode of the device is initiated;

(c) a gear assembly for connecting the drive shaft to at least one of the rollers;

(d) a clutch assembly for coupling and de-coupling the drive shaft to the gear assembly in response to a signal; and (e) control means for the operative engagement of the clutch assembly, wherein said drive motor rotates at a preselected rotational speed in a standby condition with said clutch disengaged, and said flywheel is sized to provide a motor inertia which enables the drive shaft to regain rotation at said preselected rotational speed substantially instantaneously after said clutch is engaged and said drive motor is coupled to said cutter roller, said control means being provided with an interface for connecting said control means to a radar warning receiver or to a programmable control system, and (f) means for selectively alternating between a countermeasure articles dispersal mode and a countermeasure articles non-dispersal mode by deploying an airfoil structure to effect countermeasure articles dispersal.

2. A device according to claim 1, further comprising a roving material storage compartment, and guide means for guiding roving material into the nip of the rollers.

3. A roving filament cutting and dispensing device comprising opposed platen and cutter rollers, in which the cutter roller has multiple transversely discrete surface areas along an axial extent of its surface, of differing bladed character, and means for selectively guiding roving filament to a selected one or ones of the multiple transverse discrete surface areas for cutting thereon, to produce a cut filament for dispensing.

4. A device according to claim 3, wherein the selectively guiding means are operatively coupled to sensing means for detecting a threat condition and responsively selectively guiding roving filament to said selected one or ones of the multiple transverse discrete surface areas for cutting thereon.

5. A device for the substantially instantaneous in-flight cutting and dispensing of chaff dipoles into an airstream along the flight path of an aerial vehicle, which comprises:

a. a chaff roving supply assembly comprising:

i. a chaff roving storage compartment containing at least one chaff roving;

ii. guide means adapted to guide said at least one chaff roving from said storage compartment;

b. a chaff cutting and dispensing assembly comprising:

i. a rotatable cutter roller provided with at least one cutting means;

ii. a rotatable platen roller opposing said cutter roller and forming a nip therebetween;

iii. a gear assembly in operative communication with at least one of said rollers, for the transmission of rotational power to at least one of said rollers;

wherein said at least one chaff roving from said chaff storage compartment is guided by said guiding means into said nip formed between said cutter roller and platen roller, such that rotation of at least one roller causes said chaff roving to be drawn between said rollers and be cut into dipoles of a preselected length and permitting said cut dipoles to exit the device and pass into the airstream; and, c. a drive motor assembly comprising;

i. a constant speed drive motor having a rotatable drive shaft;

ii. a flywheel affixed to said rotatable drive shaft, enabling said shaft to maintain a substantially constant rotational speed under load;

iii. a clutch assembly in operative engagement with said drive motor and said gear assembly, for coupling and decoupling said drive motor assembly to said gear assembly permitting rotation of at least one roller when engaged; and, iv. control means for the operative engagement of said clutch assembly, wherein said drive motor assembly rotates at a preselected rotational speed in a standby condition with said clutch disengaged, and said flywheel is sized to provide a motor inertia which enables the drive shaft to regain rotation at said preselected rotational speed substantially instantaneously after said clutch is engaged and said drive motor assembly is coupled to said chaff cutting and dispensing assembly, said control means being provided with an interface for connecting said control means to a radar warning receiver or to a programmable control system; and d. an exit opening provided with a moveable cover having a first standby position closing off said exit opening and a second operation position forming an airfoil assisting the dispersal of chaff dipoles into the airstream, and quickly changeable between said positions.

6. The device of claim 5, wherein said control means is manually activated.

7. The device of claim 5, where said cutter means comprises a plurality of blades extending longitudinally along said cutter roller for cutting the chaff roving, and the blades are spaced from each other circumferentially on said cutter roller.

8. The device of claim 5, wherein said cutter roller is provided with demountable mounting means, permitting said cutter roller to be readily interchanged with another cutter roller.

9. The device of claim 5, wherein the clutch assembly includes a magnetic clutch.

10. The device of claim 5, wherein said chaff roving storage compartment is provided with an access port, permitting the placement and removal of said at least one chaff roving.

11. The device of claim 10 wherein said access port permits access to said chaff roving storage compartment from outside said aerial vehicle.

12. The device of claim 5, further provided with braking means in communication with said chaff cutting and dispensing assembly, permitting rapid reduction of the rotational speed of said at least one roller in response to a signal provided thereto.

13. The device of claim 5, wherein the chaff cutting and dispensing assembly is able to reach its operational rotational speed and the device is able to cut and dispense chaff dipoles of the proper length within about 40 milliseconds after said control means is signaled to engage said clutch assembly.

14. A method of providing self-protection for a motive vehicle, comprising:

(a) providing on the vehicle a chaff cutter/dispenser mechanism for cutting chaff roving into chaff dipoles of a preselected length and dispensing the dipoles into a path of the vehicle in response to a dispense signal, said chaff cutter/dispenser mechanism comprising:

(a) rotatable cutter and platen rollers opposing each other;

(b) a drive motor having a drive shaft and a flywheel affixed thereto enabling the motor to maintain a substantially constant rotational speed when the dispense mode of the device is initiated;

(c) a gear assembly for connecting the drive shaft to at least one of the rollers;

(d) a clutch assembly for coupling and de-coupling the drive shaft to the gear assembly in response to a signal;

(e) control means for outputting a signal to the clutch assembly so as to activate the operation of the clutch assembly and control the rotation of the cutter roller, said control means being provided with an interface for connecting said control means to a radar warning receiver or to a programmable control system; and (f) means for selectively alternating between a countermeasure articles dispersal mode and a countermeasure articles non-dispersal mode by deploying an airfoil structure to affect countermeasure articles dispersal, wherein said flywheel is constructed and arranged to provide a motor inertia which enables the drive shaft to rotate at a selected speed substantially instantaneously after the gear assembly is coupled to the drive shaft;

(b) transmitting a dispense signal to the cutter/dispenser mechanism to activate the cutter/dispenser mechanism; and (d) cutting the chaff roving into the chaff dipoles and dispensing the chaff dipoles into the path.

15. A method according to claim 14, further comprising sensing an adversarial interaction condition, and in response thereto, transmitting a dispense signal to the cutter/dispenser mechanism.

16. A method for providing self-protection of an aerial vehicle against hostile radar, which method comprises:

I. providing said aerial vehicle with a device for the substantially instantaneous in-flight cutting and dispensing of chaff dipoles into an airstream along the flight path of an aerial vehicle, which comprises:

a. a chaff roving supply assembly comprising:

i. a chaff roving storage compartment containing at least one chaff roving;

ii. guide means adapted to guide said at least one chaff roving from said storage compartment;

b. a chaff cutting and dispensing assembly comprising:

i. a rotatable cutter roller provided with at least one cutting means;

ii. a rotatable platen roller opposing said cutter roller and forming a nip therebetween;

iii. a gear assembly in operative communication with at least one of said rollers, for the transmission of rotational power to at least one of said rollers;

wherein said at least one chaff roving from said chaff storage compartment is guided by said guiding means into said nip formed between said cutter roller and platen roller, such that rotation of at least one roller causes said chaff roving to be drawn between said rollers and be cut into dipoles of a preselected length and permitting said cut dipoles to exit the device and pass into the airstream; and, c. a drive motor assembly comprising:

i. a constant speed drive motor having a rotatable drive shaft;

ii. a flywheel affixed to said rotatable drive shaft, enabling said shaft to maintain a substantially constant rotational speed under load;

iii. a clutch assembly in operative engagement with said drive motor and said gear assembly, for coupling and decoupling said drive motor assembly to said gear assembly permitting rotation of at least one roller when engaged;

iv. control means for the operative engagement of said clutch assembly, and, v. an exit opening provided with a moveable cover having a first standby position closing off said exit opening, and a second operational position forming an airfoil assisting the dispersal of chaff dipoles into the airstream, and quickly changeable between said positions, wherein said drive motor assembly rotates at a preselected rotational speed in a standby condition with said clutch disengaged, and said flywheel is sized to provide a motor inertia which enables the drive shaft to regain rotation at said preselected rotational speed substantially instantaneously after said clutch is engaged and said drive motor assembly is coupled to said chaff cutting and dispensing assembly, said control means being provided with an interface for connecting said control means to a radar warning receiver or to a programmable control system, II. providing a dispense signal to said control means of said chaff cutting and dispensing device, activating said chaff cutting and dispensing device thereby; and III. cutting and chaff roving into chaff dipoles and dispensing said chaff dipoles directly into the airstream.

17. The method of claim 16, wherein the dispense signal is provided to said chaff cutting and dispensing device is provided to said device manually.

18. The method of claim 16, wherein a hostile radar signal is detected by a radar warning receiver, said radar warning receiver outputs an indicator signal, and said indicator signal is converted to a dispense signal, activating said chaff cutting and dispensing device.

* * * * *

UNITED STATES PATENT AND TRADEMARK OFFICE

CERTIFICATE OF CORRECTION

PATENT NO. : 5,773,745

DATED : June 30, 1998

INVENTOR(S) : Widmer

It is certified that error appears in the above-indentified patent and that said Letters Patent is hereby corrected as shown below:

Column 14, Line 35 change "assembly, and" to -- assembly; and --.

Signed and Sealed this

Seventeenth Day of November, 1998

*Attest:*

Bruce Lehman

BRUCE LEHMAN

*Attesting Officer*

*Commissioner of Patents and Trademarks*